US007802692B2

(12) United States Patent
Maejima et al.

(10) Patent No.: US 7,802,692 B2
(45) Date of Patent: Sep. 28, 2010

(54) DEVICE FOR AND METHOD OF FASTENING TWO COMPONENT MEMBERS

(75) Inventors: Hitoshi Maejima, Tokyo (JP); Tadashi Maejima, Tokyo (JP)

(73) Assignee: Three R Produce, Inc., Tokyo (JP)

( * ) Notice: Subject to any disclaimer, the term of this patent is extended or adjusted under 35 U.S.C. 154(b) by 0 days.

(21) Appl. No.: 10/758,161

(22) Filed: Jan. 15, 2004

(65) Prior Publication Data

US 2005/0155970 A1 Jul. 21, 2005

(51) Int. Cl.

| | |
|---|---|
| ***B65D 41/04*** | (2006.01) |
| *F16L 15/00* | (2006.01) |
| *F16L 39/04* | (2006.01) |
| *F16B 35/06* | (2006.01) |

(52) U.S. Cl. ..... 220/293; 220/289; 411/413; 411/415; 285/390; 285/391; 285/291.1; 285/291.2

(58) Field of Classification Search ..... 215/330–331, 215/44, 329; 220/293, 296, 289, 288; 411/412, 411/413, 415, 411; 285/33, 291.2, 291.1, 285/390, 391

See application file for complete search history.

(56) References Cited

U.S. PATENT DOCUMENTS

| | | | | |
|---|---|---|---|---|
| 1,849,522 | A * | 3/1932 | Hammer | 215/262 |
| 4,346,920 | A * | 8/1982 | Dailey | 285/89 |
| 4,387,822 | A * | 6/1983 | Lynn | 215/330 |
| 4,640,430 | A * | 2/1987 | Haines | 215/330 |
| 4,784,658 | A * | 11/1988 | Grabenkort | 604/410 |
| 5,290,260 | A * | 3/1994 | Stines | 604/224 |
| 5,398,830 | A * | 3/1995 | de Pous et al. | 215/324 |
| 5,690,241 | A * | 11/1997 | Montgomery | 215/28 |
| 6,695,160 | B1 * | 2/2004 | Culley et al. | 215/329 |
| 6,913,157 | B2 * | 7/2005 | Oh | 215/330 |
| 7,097,790 | B2 * | 8/2006 | Jochem | 264/40.4 |

(Continued)

FOREIGN PATENT DOCUMENTS

| | | |
|---|---|---|
| DE | 1089292 | 3/1961 |

(Continued)

OTHER PUBLICATIONS

German Application No. 10 2004 002 373.5-12, Office Action of Mar. 16, 2007.

*Primary Examiner*—Robin Hylton
(74) *Attorney, Agent, or Firm*—Cowan, Liebowitz & Latman, P.C.; Mark Montague, Esq.

(57) ABSTRACT

A device and method for fastening two component members. The device includes a first component member including at least two protruded portions each having a predetermined lead angle, and a second component member which keeps predetermined positional relationship with the first component member and has at least two protruded portions which are engaged with the protruded portions of the first component member, among at least two of which protruded portions, at least one of the protruded portion has a different lead angle from the lead angle of the protruded portions of the first component member, and the first and second component members can be moved closer opposite each other, the protruded portions are engaged with each other after moving opposite each other by a certain distance, and the first and second component members are integrally fixed by frictional engagement of the protruded portions differing in the lead angle.

18 Claims, 9 Drawing Sheets

U.S. PATENT DOCUMENTS

| | | | |
|---|---|---|---|
| 2003/0160020 | A1 | 8/2003 | Oh |

FOREIGN PATENT DOCUMENTS

| | | | | |
|---|---|---|---|---|
| DE | 1 993 453 | U | | 9/1968 |
| GB | 2 088 518 | A | | 5/1982 |
| JP | 47-45973 | | | 11/1972 |
| JP | U-S53-025849 | | | 3/1978 |
| JP | U-S62-182241 | | | 11/1987 |
| JP | U-S49-144653 | | | 12/1987 |
| JP | U-S64-017956 | | | 1/1989 |
| JP | H06-049351 | | | 6/1991 |
| JP | U-5-1010 | | | 1/1993 |
| JP | 08-258855 | | | 10/1996 |
| JP | 2000-179700 | A | * | 2/2000 |
| JP | A-2002-34650 | | | 2/2002 |

* cited by examiner

DEVICE FOR AND METHOD OF FASTENING TWO COMPONENT MEMBERS

BACKGROUND

The present invention relates to a device for and a method of fastening two component members in an injection-molded product or the like, and particularly relates to a device for and a method of fastening the component members by frictionally engaging protruded portions, such as screws or threads, provided on the component members.

It is common to use screws as a method of fastening various kinds of containers, particularly in the technical field in which two component members are fixed to each other such as when a lid is fastened to a container.

Generally in a screw type of fastening method the lead angle of each screw that performs the fastening is fixed. When this method is adopted in a lid of a container, fastening is performed by screws having a fixed lead angle that brings an interior ceiling surface of the lid and a planar surface at the opening of the container firmly in contact with each other. During the production of such a lid or a container, when the product is released from a core of a mold of injection molding, the core is rotated to eject the product, and therefore a screw having a fixed lead angle is used to facilitate mold-release.

A method for fastening two members having two kinds of screws with different lead angles is described in JP-A2002-34650, in which the moving speed of each member is made different in accordance with each kind of lead angle.

A device for fastening a bolt and a nut is described in JP-U-5-1010, wherein a left thread groove and a right thread groove with different lead angles are formed on one bolt and separate nuts having thread ridges that are screwed into the thread grooves with the corresponding lead angles of the bolt.

In a conventional fastening device, when screws are used as fixing means it is common for the lead angles of the screws to all be fixed. Consequently, a fastening force is obtained from the elastic deformation and frictional force of a male screw and a female screw, irrespective of the kind of material, and therefore a large rotation moment is required to obtain a strong fastening force. Accordingly, the fastening force is influenced by variations in the fastening rotational force of a lid on a container or the like, and there exists the problem that the lid may also be loosened easily.

With regard to the fastening rotational force of the lid, the rotational force applied after the interior ceiling surface of the lid and the planar surface opening of the container are in contact with each other contributes to the fastening force. Therefore, the frictional force of the lid's interior ceiling surface and the container opening's planar surface may result in a large loss of the lid's rotation force causing a wide variation in the fastening force.

With regard to fastening with screws having one kind of lead angle, a stopper is always needed at one end as in the relationship of a bolt and a nut and of a container and a lid, and fastening cannot be obtained in an optional place, thus limiting its use. Therefore, a fastening device with a bolt and a nut as described in JP-U-5-1010 is an alternative, but requires very special working and demands materials having a particular strength, which makes the device difficult to manufacture.

With regard to the fastening device with screws having different lead angles as described in JP-A2002-34650, two kinds of screws with different lead angles are disposed in parallel, which increases the handling convenience by having different moving speeds. However, this device is not intended for fastening itself.

SUMMARY

The present invention is made in view of the problems as described above, and has as its object to provide a fastening device and a fastening method that is capable of fastening two component members by one operation without including a special mechanism.

The present invention also has as its object to provide a fastening device and a fastening method for two component members capable of stabilizing a fastening force and fastening at any optional place by obtaining the fastening force using only elastic deformation and a frictional force of a male screw and a female screw, wherein the screws utilize at least two kinds of lead angles.

In order to attain the above described object, a fastening device for two component members according to the present invention is characterized by comprising a first component member including at least two protruded portions having a predetermined lead angle, and a second component member including at least one protruded portion and which, in a predetermined positional relationship with the first component member, opposes and engages with the protruded portion of the first component member and has a different lead angle from the lead angle of the protruded portion of the first component member, and is characterized in that as first and second component members are moved closer opposite each other, the protruded portions are engaged with each other after moving opposite each other by a certain distance, and are further frictionally engaged with each other so that the first and second component members are integrally fixed.

The fastening device is characterized in that the first and second component members are formed of an elastic material. After the protruded portions are engaged with each other, the protruded portions are elastically deformed by each other by a certain distance, and the engaged relationship is maintained by the frictional engagement.

The fastening device is characterized in that the component members of this fastening device can be a cylindrical container having an open end portion and a lid for the open end portion, and the protruded portions are threads of a male screw formed on an outer peripheral wall of the open end portion and threads of a female screw formed on an inner peripheral wall of the lid.

The fastening device is characterized in that the first and second component members of this fastening device are each provided with an even number of threads, and the protruded portions each with the different lead angle are provided alternately in one of the component members.

The fastening device is characterized in that when the threads on the inner wall of the lid are engaged with and fastened to the threads formed at the open end portion of the cylindrical container in the above described fastening device, the inner ceiling surface of the lid is brought into contact with and fastened to a planar surface defining an opening at the open end portion of the container.

A fastening method for two component members according to the present invention is a method for fastening a first component member formed of an elastic member including at least one protruded portion, which opposes and engages with a protruded portion of a second component member and has a different lead angle from a lead angle of the protruded portion of the second component member, to the second component member including at least one protruded portion having the predetermined lead angle, while keeping a predetermined positional relationship, and is characterized by comprising the steps of: moving the first and second component members opposite each other until the protruded portions are engaged with each other by a certain distance; moving the first and second component members further together so that the protruded portions are elastically deformed after the engagement with each other; frictionally engaging the protruded portions with each other by the elastic deformation; and fastening the first and second component members to each other.

In the fastening device for two component members of the above described construction, the first component member includes at least two protruded portions each having a predetermined lead angle, and the second component member has at least one protruded portion which, in a predetermined positional relationship with the first component member, is engaged with the protruded portion of the first component member opposite this protruded portion and has a different lead angle from the lead angle of the protruded portions of the first component member. Therefore, when the first and second component members are moved toward each other, the protruded portions are engaged with each other after moving opposite each other by a certain distance, and the protruded portions are further moved as they are engaged with each other, whereby the protruded portions are further firmly and frictionally engaged with each other, and the first and second component members are integrally fixed. If the engaging points are optionally set at the preferred locations, an engaged state of the first and second component members can be obtained that corresponds to the purpose for which the component members are used.

Further, in the fastening device, the first and second component members are formed of an elastic material, and therefore after the protruded portions are engaged with each other, the engaged state is maintained by elastic deformation while the first and second component members are engaged with each other by movement relative to one another, and the engaged relationship is kept by the frictional engagement, thus making it possible to establish a stronger fastening state of the first and second component members.

Since the component members in this fastening device can be an open end portion of a cylindrical container such as a bottle, and a lid for closing the open end portion, and the protruded portions are threads of a male screw formed on an outer peripheral wall of the open end portion and threads of a female screw formed on an inner peripheral wall of the lid, the lid can be fitted onto the open end portion of the container by being screwed onto it, and on this occasion, because the threads of the open end portion of the container and the threads on the inner wall of the lid differ in the lead angle, the threads are engaged with each other after movement relative to one another, and the screwing work is further continued, whereby the threads are frictionally engaged with each other by elastic deformation and both of them are in a fixed state, thus making it possible to fasten the lid to the open end portion of the container.

At each of the component members of the container and the lid of this fastening device, an even number of threads are provided, and the threads with the different lead angle are provided alternately, which results in the existence of a plurality of engaging points for the threads, and a plurality of points at which the engaging friction occurs, thus making it possible to strengthen the fastening by screwing the lid into the open end portion of the container.

When the threads on the inner wall of the lid are engaged with and fastened to the threads formed at the open end portion of the cylindrical container in the above described fastening device, the threads are further elastically deformed by each other by further screwing action of the lid to be frictionally engaged with each other and fastened to each other, and on this occasion, the inner ceiling surface of the lid is brought into contact with the surface defining the opening at the open end portion of the container, thus making it possible to keep the lid in a firmly sealed state to the container.

Further, a fastening method for first and second component members according to the present invention is for fastening the first component member formed of an elastic member including at least one protruded portion, which opposes and engages with a protruded portion of the second component member and has a different lead angle from a lead angle of the second component member, to the second component member including at least one protruded portion having a predetermined lead angle. Therefore the first and second component members are moved together until the protruded portions are opposed and engaged with each other by a certain distance, the first and second component members are further moved so that the protruded portions are elastically deformed in the state in which they are engaged with each other by a certain distance, the protruded portions are frictionally engaged with each other opposite each other by the elastic deformation by a certain distance, and the first and second component members can be firmly fastened to each other in a frictional engaged state in which both the protruded portions are elastically deformed.

BRIEF DESCRIPTION OF THE DRAWINGS

FIG. 1A is a partial plan view showing a detached state of the two component members, FIG. 1B is a partial plan view showing a midway engaged state of both of the component members, and FIG. 1C is a partial plan view in which both of the component members are in a fastened state.

DESCRIPTION OF THE INVENTION

Figure 1A:
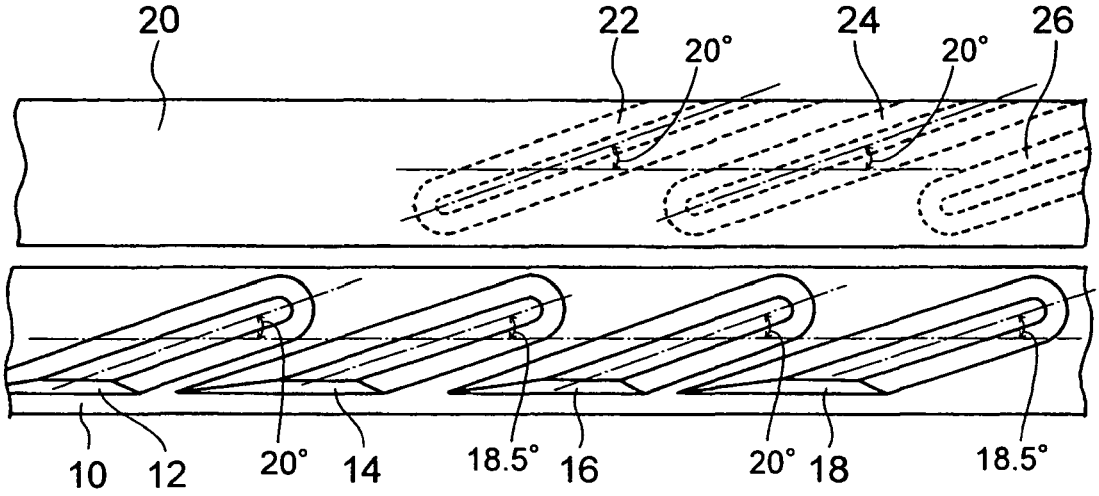
FIGS. 1A, 1B and 1C show a fastening device for two component members according to one embodiment of the present invention.

An embodiment of a fastening device according to the present invention will be explained hereinafter with reference to the drawings. In the embodiment of the present invention, the explanation will be made with an open end portion of such a container as is provided as an injection-molded product and a lid which is attached to the open end portion by being screwed onto it. It is understood that this is merely an example of one application of the present invention and that the fastening device is not so limited.

FIGS. 1A, 1B and 1C and FIG. 2 show a fastening device comprising one component member 10 provided with protruded portions 12, 14, 16, 18, and another component member 20 provided with protruded portions 22, 24, 26, 28. Both of the component members 10, 20 may be formed of an elastic material such as a resin.

Figure 1B:
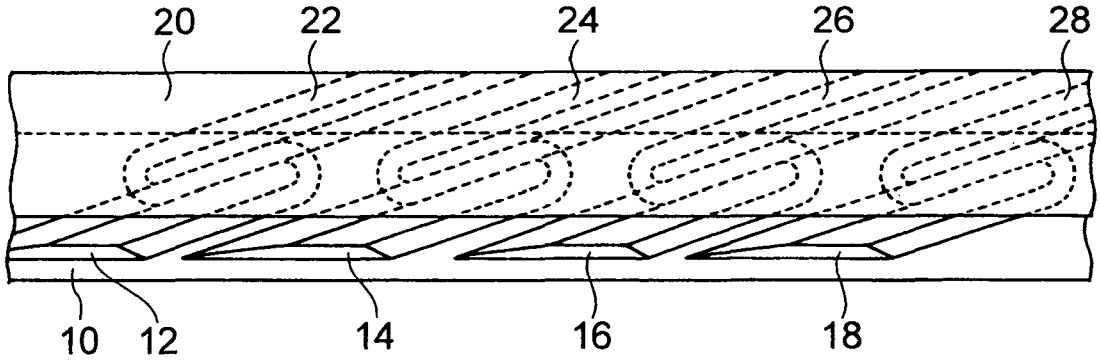
Figure 1C:
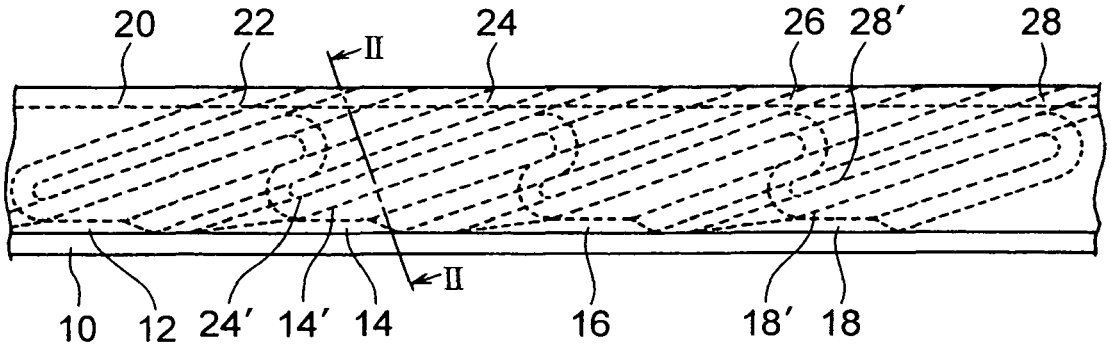

FIG. 1A shows a state in which component members 10, 20 are disengaged from each other, FIG. 1B shows a state in which the protruded portions of component members 10, 20 are moved into engagement with each other, and FIG. 1C shows a state in which the component members 10, 20 are moved relative to one another so that the protruded portions are brought into a fastened state. In this manner, the component members 10, 20 are held at positions where they can move predetermined distances relative to each other, and can be disengaged from each other.

Referring to FIGS. 1A and 1C, the second and forth protruded portions 24, 28 of the second component member 20 are engaged with the second and forth protruded portions 14, 18 of the first component member 10 which have lead angles of 18.5°. The first and third protruded portions 12, 16 of the first component member 10 have the same lead angles of 20° as the protruded portions 22, 24, 26, 28 of the second component member 20.

Both of the component members 10, 20 are constructed so as to be positioned in the engaged state as shown in FIG. 1B from the disengaged state in FIG. 1A. As a result, the protruded portions 12, 14, 16, 18 of the first component member 10 and the protruded portions 22, 24, 26, 28 of the second component member 20 slide in their lead angle directions into each other, have predetermined positional relationships, and are capable of being brought into the fastened state as shown in FIG. 1C. Protruded portions having the same lead angles 12, 16, 22, 26 are slid and moved relative to each other until the component members 10, 20 are combined with each other, and then protruded portions with different lead angles 14, 24 are engaged with each other. Since the component members 10, 20 are held to keep the predetermined positional relationship by the sliding relation of protruded portions with the same lead angles, protruded portions 14, 24 with the different lead angles are bent as they are elastically deformed by each other, and they are frictionally engaged with each other in such a manner as the one sinks into the other, whereby the component members 10, 20 can be fixed at the position in the fastened state as shown in a sectional view in FIG. 2.

Figure 2:
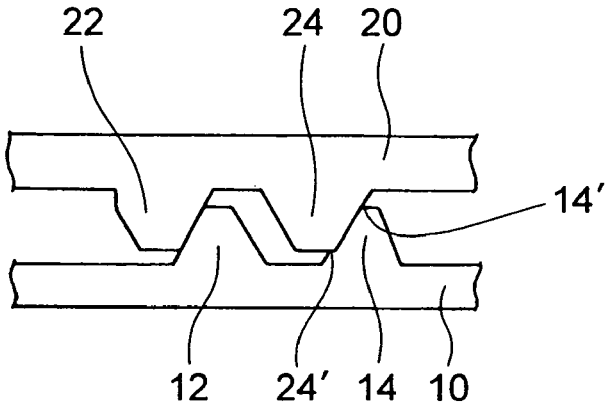
FIG. 2 is a side view of the two component members taken along the line II in FIG. 1C.

In the fastened state shown in FIG. 1C, first and third protruded portions 22, 26 of the second component member 20 slide along the first and third protruded portions 12, 16 of the first component member 10 to move both of the component members 10, 20 toward each other. The protruded portions 14, 18, 24, 28 with different lead angles are engaged with each other. The second and forth protruded portions 24, 28 of the second component member 20 advance against the second and forth protruded portions 14, 18 with the smaller lead angles of the first component member 10 and are elastically deformed by each other and firmly pressed against each other to make it possible to establish the fastened state by frictional engagement. The engaged state by elastic deformation of the protruded portions 14, 18, 24, 28 can achieve the fastened state as shown in FIG. 2 which is the sectional view taken along the line II in FIG. 1C. Deformed portions 14' and 24' and 18' and 28' are shown in FIG. 1C.

As described above and as shown in FIG. 3, the fastening device of the two component members according to one embodiment of the present invention is in a screw type of lid 1 of a container or the like, such as in an injection-molded product, and a container 5 of the injection-molded product which is closed using the lid 1. The lid 1 has female screws 3*a*, 3*b*, as shown in FIG. 4, having one kind of lead angle of 20° formed on an inner portion of lid body 2. The lid 1 is fastened to container 5 in FIG. 3 using the female screws 3*a*, 3*b*.

Figure 3:
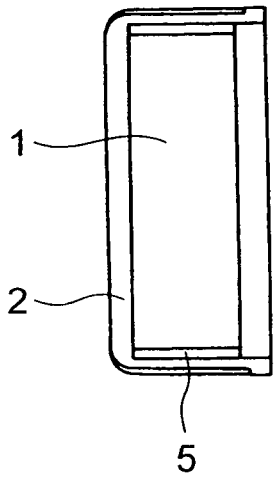
FIG. 3 is a sectional view of a lid of a screw type of container according to another embodiment of the present invention.
Figure 4:
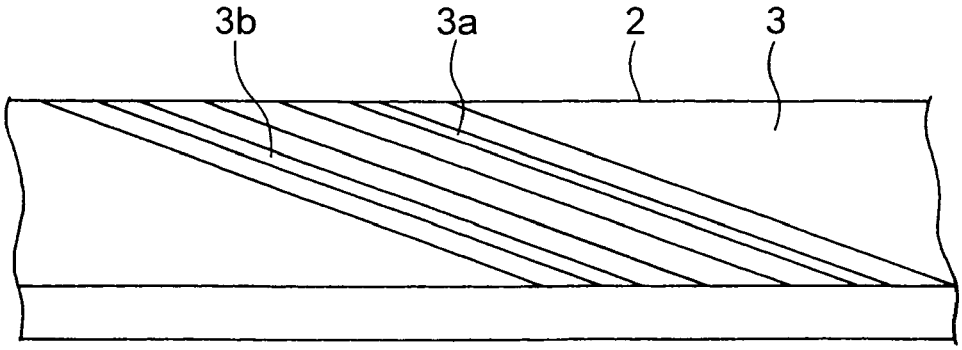
FIG. 4 is a schematic view of a screw portion of the lid shown in FIG. 3.
Figure 5:
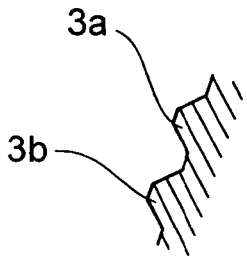
FIG. 5 is a partial sectional view of the screw portion of the lid shown in FIG. 4.

FIG. 4 shows a screw portion 3 of the lid 1 shown in FIG. 3. The screw portion 3 has female screws 3*a*, 3*b* having one kind of lead angle. In the screw portion 3, the female screws 3*a*, 3*b* have lead angles of 20° and are disposed on the lid body 2. Four to eight of the female screws 3*a*, 3*b* are normally disposed on the circumference. FIG. 5 is a sectional view of screw portion 3 shown in FIG. 4 showing the female screws 3*a*, 3*b*.

Figure 6:
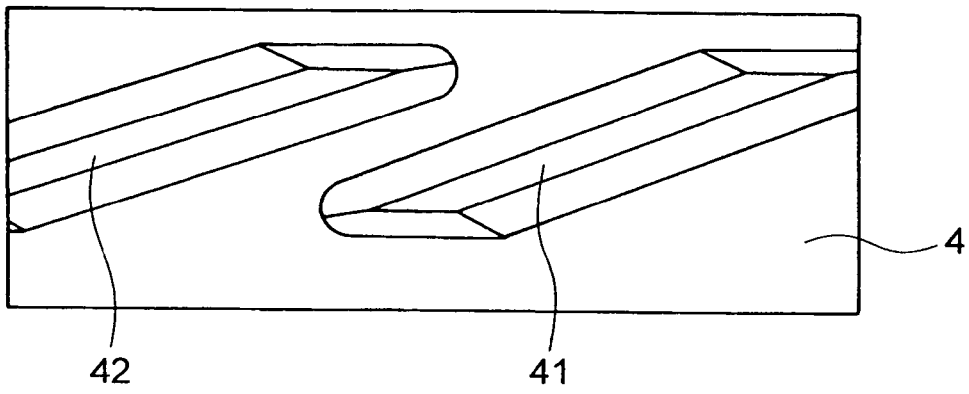
FIG. 6 is a partial elevational view of an opening of a container according to another embodiment of the present invention.
Figure 7:
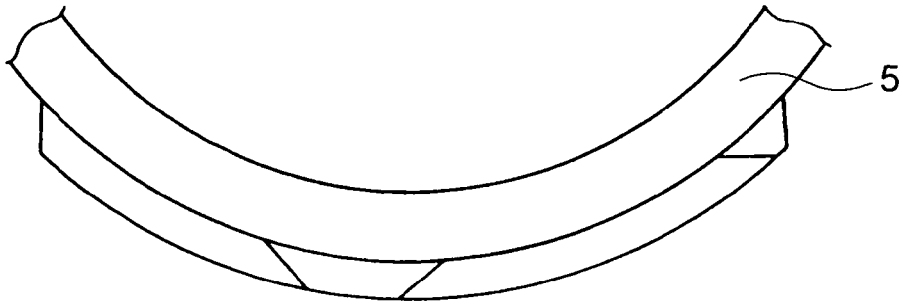
FIG. 7 is a partial plan view of the opening of the container shown in FIG. 6.
Figure 8:
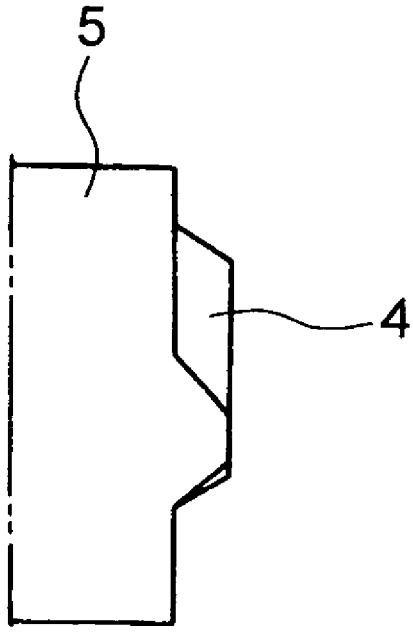
FIG. 8 is a partial sectional view taken along a center, axis line of the opening of the container shown in FIG. 6.
Figure 9:
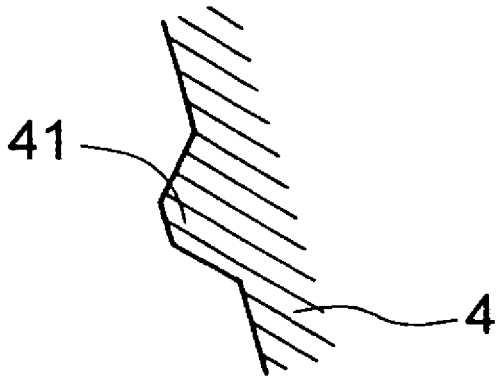
FIG. 9 is a sectional view perpendicular to a longitudinal direction of a male screw in the opening of the container shown in FIG. 6.

FIG. 6 shows a screw portion 4 of a container having two kinds of male screws 41, 42 with different lead angles according to one embodiment of the present invention. In the screw portion 4, the male screw 41 having the lead angle of 20° and the male screw 42 having the lead angle of 18.5°, which is slightly different from male screw 41, are disposed on the container 5, as shown in a plan view of the opening of the container body 5 in FIG. 7, a sectional view in an axis line direction of the container body 5 in FIG. 8, and a sectional view taken perpendicularly to the lead direction of the male screw 41 in FIG. 9. Four to eight of these male screws 41, 42 are normally disposed on the circumference of the container adjacent the opening. It is generally suitable to dispose the male screws 42 with different lead angles alternately when a number of male screws 42 are provided. Accordingly, four to eight or more of an even number of screws may be provided according to the purpose for which the screws are used.

An angle difference of the two kinds of lead angles as above is typically no greater than about 2°, preferably from about 1° to about 2°, and more preferably about 1.5°; however, an angle difference out of this range may be adopted depending on the purpose for which the screws are used. The lead angles themselves are preferably at least about 10° and no greater than about 30°; however, lead angles out of this range may be adopted depending on the purpose for which the screws are used. Though not shown in FIG. 3 to FIG. 9, the screws with the same lead angles and the same number of screw threads are respectively provided at the male screw side of the container or the like and the female screw side of the lid and the like other than the screws with different lead angles at the male screw side.

The relationship between the above described container 5 and lid 1 will be explained with reference to FIG. 10 to FIG. 14 in an example of a lid in a circular shape and an opening of a container. On this occasion, the same portions as the portions shown in FIG. 3 to FIG. 9 are given the same reference numerals and characters.

Figure 10:
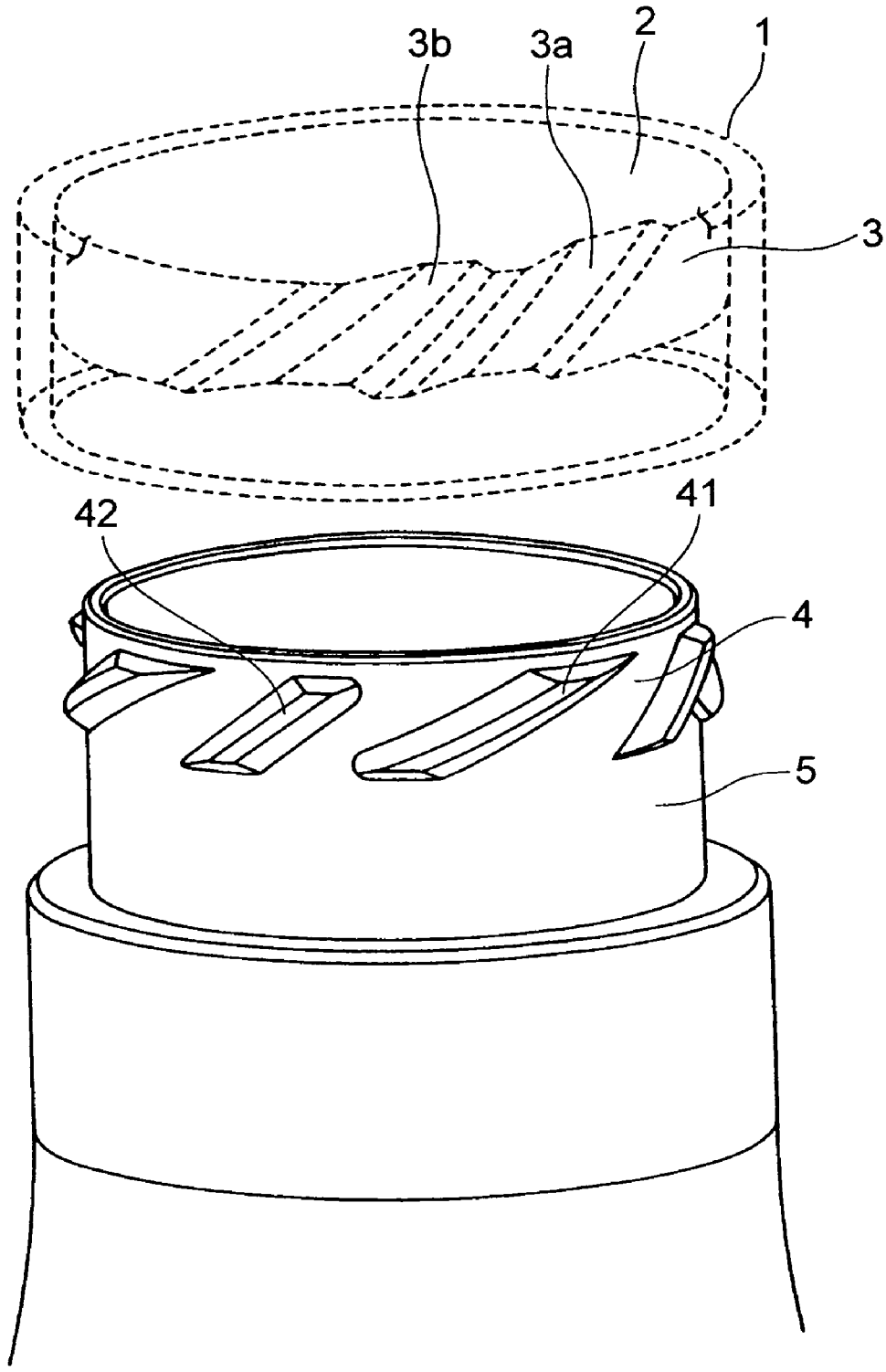
FIG. 10 is a perspective view of an open end portion of a container and its lid according to still another embodiment of the present invention.

As shown in FIG. 10, the opening of the cylindrical body of container 5 has a screw portion 4 comprising a plurality of male screws 41, 42 that are formed on an outer peripheral wall of the opening of container 5. The male screws 41, 42 are alternately provided where the lead angles are different by about 1° to 2° from each other. The crown-shaped lid 1 has a plurality of female screws 3*a*, 3*b* formed on its inner peripheral wall with the number of screw threads and the lead angles being made the same as those of one set of the male screws 42 on the side of container 5.

Figure 11:
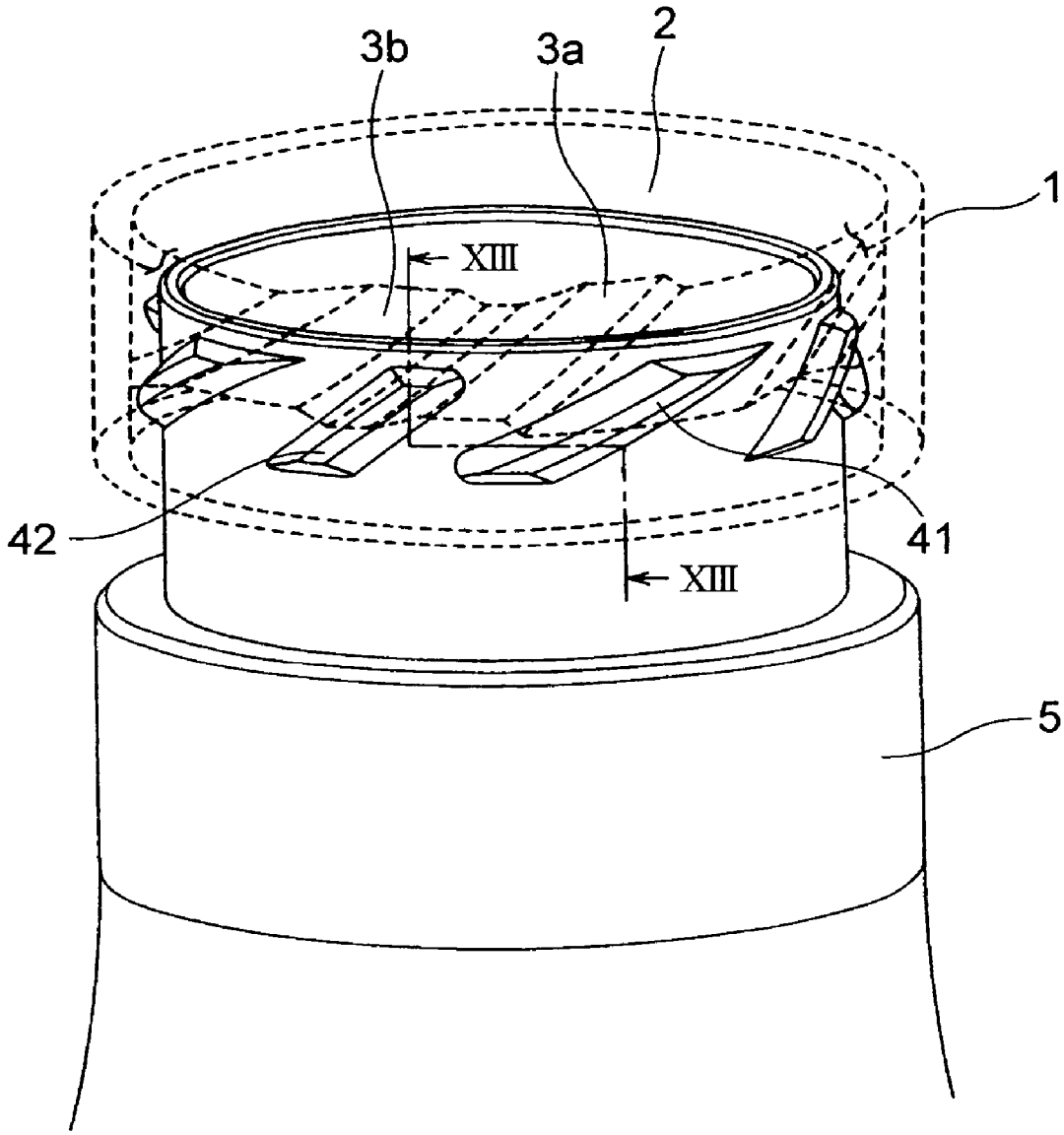
FIG. 11 is a perspective view showing the lid to be fitted onto the open end portion of the container shown in FIG. 10.
Figure 13:
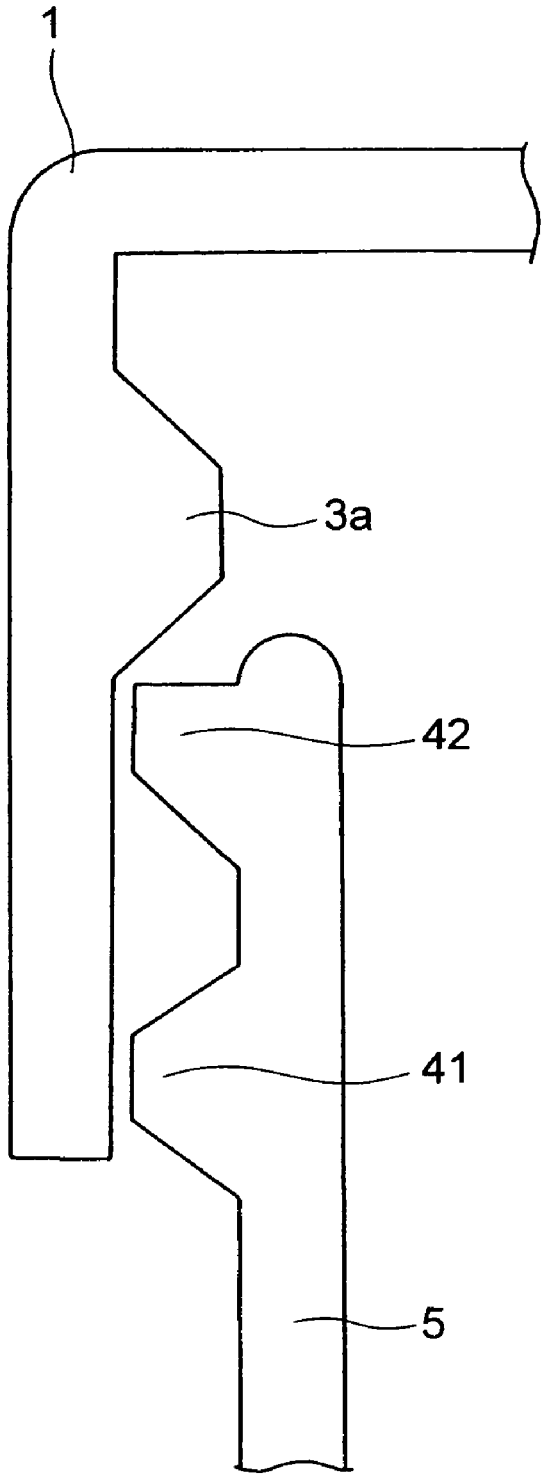
FIG. 13 is a partial sectional view taken along the line XIII of FIG. 11.

From the detached state as shown in FIG. 10, the lid 1 is screwed onto the container 5 until the female screws 3*a* of the lid 1 are engaged with the male screws 41 with smaller lead angles of the container body 5 as shown in FIG. 11. In this position, the female screws 3*a* of the lid 1 slide against the male screws 42 of the container body 5 along the screw surfaces of each other, which makes it possible to maintain this engaged state while keeping the positional relationship of the lid 1 and the container body 5. A state just before this engaged state is shown in FIG. 13 which is a sectional view taken along the line XIII in FIG. 11, in which the female screw 3*a* is not engaged with inclined surface portions of the male screws 41, 42. However, at the advance side of the female screw 3*a*, the sliding relation is already established at the inclined surface portion of the male screw 42, and an end portion of the inclined surface portion of the male screw 41 is at the position just before engaging.

Figure 12:
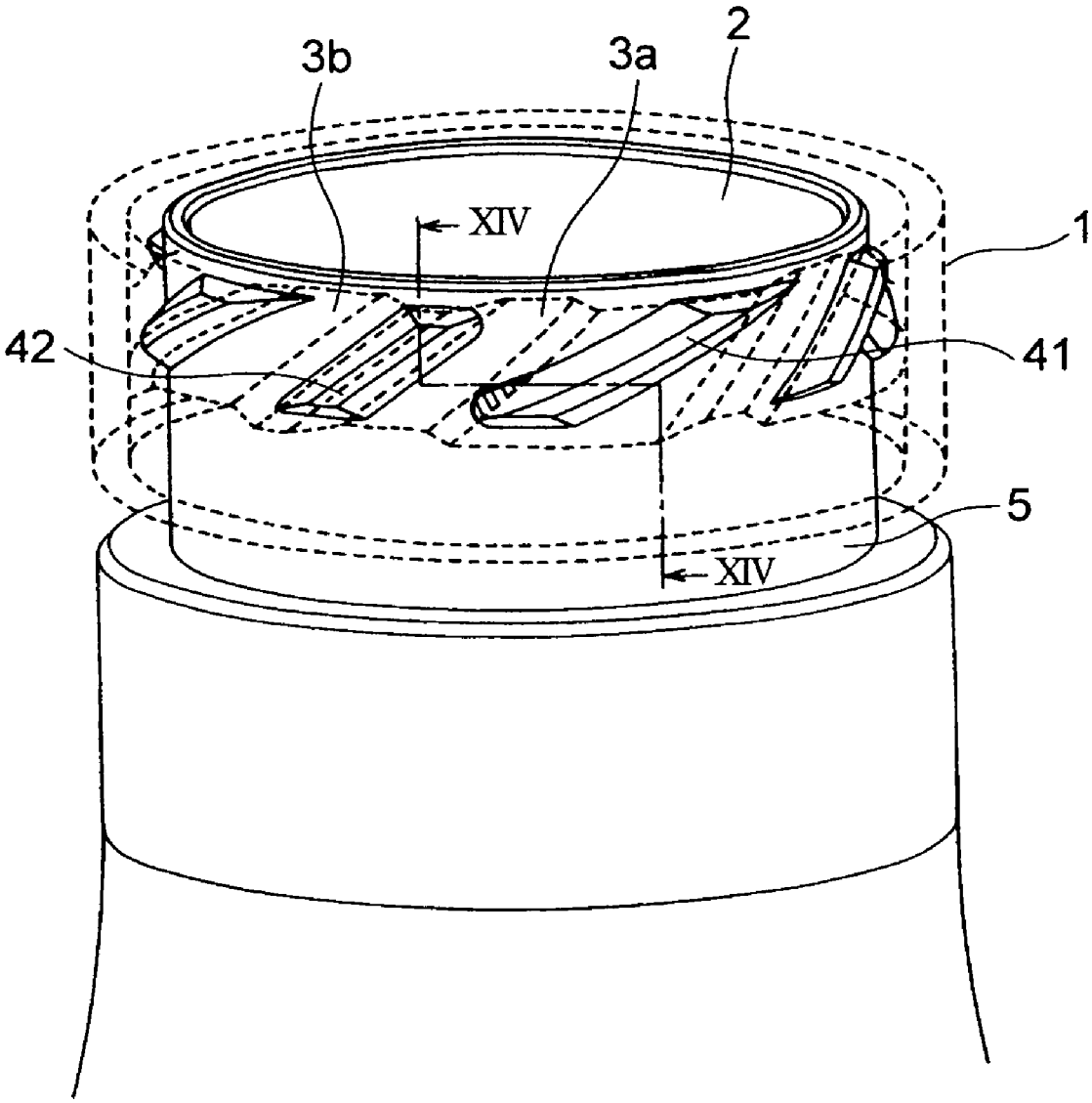
FIG. 12 is a perspective view showing a state in which the lid is fitted onto and fastened to the open end portion of the container shown in FIG. 10.
Figure 14:
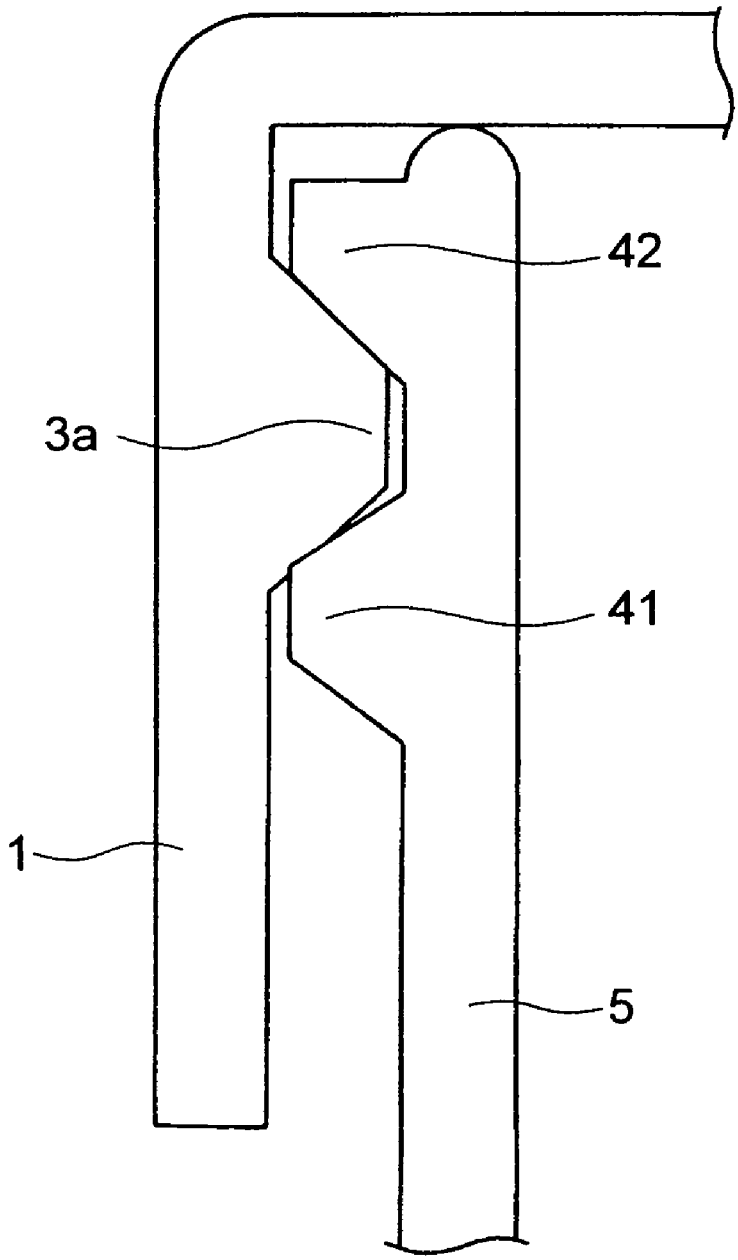
FIG. 14 is a sectional view taken along the line XIV of FIG. 12.

When the lid 1 is further screwed in, as shown in FIG. 12, the female screw 3*a* of the lid 1 is engaged with the end portion of the inclined surface portions of the male screw 41 with the smaller lead angle of the container body 5. Thereafter, as they are bent and elastically deformed by being engaged, as shown by the oblique line in FIG. 12, the screwing movement by rotation is continued until the lid 1 is pressure-fitted to the opening of the container body 5, whereby the friction engagement provides a sealed state to the lid 1 and the container body 5. In the engaged state, the inclined surface portion of the female screw 3*a* of the lid 1 is press-fitted into the inclined surface portion of the male screw 41 of the container body 5, as shown in FIG. 14 which is a sectional view taken along the line XIV in FIG. 12. The other inclined surface portion of the female screw 3*a* is engaged with the inclined surface portion of the adjacent male screw 42 in a surface contact state because the lead angles are the same, as shown in FIG. 14. In such a press-fitted state of the screws, a strong pressure-contact state is obtained, and the fastening of the lid 1 and the container body 5 is accomplished. In this position, a ceiling inner wall of the lid 1 is in pressure contact with the opening of the container body 5 by screwing, and therefore high sealing performance can be given when sealing is needed.

The lid 1, container 5, and the like can be obtained by injection molding, and since in an injection mold for this purpose, the screw portion 3 of the lid 1 becomes a core side, a screw-shaped recessed groove can be easily worked on the core surface with a numeral control machine tool or the like. Since an injection mold for the container 5 is the mold of the blow molding or the like, a split mold is used, and therefore the product can also be easily manufactured. As for ejection after molding, the product can be easily removed since the mold is split, and accordingly, mold-release can be easily performed.

As described above, when the screws of the container and the lid are engaged and rotated, fastening is started with a little rotation since the screws with different lead angles are provided. The fastening principle is the fastening in a wedge form, and therefore all of the rotational force of the lid becomes a fastening force, thus making stable fastening possible.

Since fastening is made with the elastic deformation and the frictional force of the male screws and the female screws, the male screws are each formed into a bar shape, and the female screws, for example, in a ring shape can be fastened at optional locations of the male screws.

In the above described embodiment, the explanation is made with the lid of the container or the like as an example. However, it is understood that the fastening device according to the present invention is also applicable to precision machinery industry products such as various kinds of home electric appliances, office automation instruments or systems, cameras, and automobiles, and is not intended to be limited to the general household commodities.

The explanation is made with the case in which the protruded portions, specifically, the lead angles of the screws have two kinds of lead angles, but it is possible to apply the device including the protruded portions having an optional number of different lead angles.

As is obvious from the explanation thus far, a fastening device using screws, which are the protruded portions having many kinds of lead angles, according to the present invention is capable of enhancing the quality of the device by making it possible to fasten the device using with only a small rotational force and obtaining a stable fastening force.

The first component member can be fastened to the second component member at an optional location. It is also possible to apply the fastening device for various purposes. Thus, the application of the fastening device can be expanded by providing an easy method of fastening two components.

Specific embodiments of an invention are described herein. One of ordinary skill in the mechanical arts will quickly recognize that the invention has other applications in other environments. In fact, many embodiments and implementations are possible. The following claims are in no way intended to limit the scope of the invention to the specific embodiments described above.

We claim:

1. A fastening device, comprising:

a first component member including a plurality of threads of a female screw formed on an inner peripheral wall of said first component member and each of said threads of the first component member having a same predetermined lead angle; and a second component member having an open end portion and including a plurality of threads of a male screw formed on an outer peripheral wall of said open end portion so as to engage with the threads of said first component member, at least two of the threads of said second component member disposed on said second component member and extending along their length at a first lead angle relative to the open end of said second component member and at least another one of the threads of said second component member disposed on said second component member and extending along its entire length at a second lead angle relative to the open end of said second component member and disposed between two of the threads of the second component member disposed at the first lead angle, the first and second lead angles being different and the first lead angle being the same as the predetermined lead angle of the threads of the first component member, said first and second component members being formed of an elastic material, wherein when said first and second component members are moved closer from a first relative position to a second relative position, one of the threads of the female screw initially slides against a thread of the male screw having the second lead angle to result in the first and second component members engaging each other, and when said threads of the first and second component members engage, said threads are elastically deformed by each other by moving said threads at a distance, and said first and second component members are fixed in the second position while maintaining their engaged relationship by the frictional engagement of the threads differing in said lead angle.

2. The fastening device according to claim 1, wherein each of said first and second component members includes an even number of threads.

3. The fastening device according to claim 1, wherein when the threads on the inner wall of said first component member are engaged with the threads formed at the open end portion of said second component member, an inner ceiling surface of said first component member is brought into contact with the surface of said open end portion of said second component member defining the opening.

4. The fastening device according to claim 1, wherein the difference between the predetermined lead angle of the threads of said first component member and the second lead angle of the at least another one of the threads of said second component member is from about 1° to about 2°.

5. The fastening device according to claim 1, wherein the difference between the predetermined lead angle of the threads of said first component member and the second lead angle of the at least another one of the threads of said second component member is at least about 1°.

6. The fastening device according to claim 1, wherein the difference between the predetermined lead angle of the threads of said first component member and the second lead angle of the at least another one of the threads of said second component member is less than about 2°.

7. The fastening device according to claim 1, wherein the difference between the predetermined lead angle of the threads of said first component member and the second lead angle of the at least another one of the threads of said second component member is about 1.5°.

8. The fastening device according to claim 2, wherein threads of the second component member that extend at the first lead angle alternate within the second component member with threads that extend at the second lead angle.

9. A fastening device, comprising:

a first component member, including a plurality of threads of a female screw formed on an inner peripheral wall of said first component member, at least two of the threads of said first component member disposed on said first component member and extending along their length at a first lead angle relative to the outer edge of the inner peripheral wall and at least one of the threads of said first component member disposed on said first component member and extending along its entire length at a second lead angle relative to the outer edge of the inner peripheral wall and disposed between two of the threads of the first component member disposed at the first lead angle, the first and second lead angles being different; and a second component member having an open end portion and including a plurality of threads of a male screw formed on an outer peripheral wall of said open end portion so as to engage with the threads of said first component member, and each of said threads of said second component member having a predetermined lead angle that is the same as the first lead angle of said at least one of the threads of said first component member, said first and second component members being formed of an elastic material, wherein when said first and second component members are moved closer from a first relative position to a second relative position, one of the threads of the female screw initially slides against a thread of the male screw having the second lead angle to result in the first and second component members engaging with each other, and when said threads of the first and second component members engage, said threads are elastically deformed by each other by moving said threads at a distance, and said first and second component members are fixed in the second position while maintaining their engaged relationship by the frictional engagement of the threads differing in said lead angle.

10. The fastening device according to claim 9, wherein each of said first and second component members includes an even number of threads.

11. The fastening device according to claim 9, wherein when the threads on the inner wall of said first component member are engaged with the threads formed at the open end portion of said second component member, the inner ceiling surface of said first component member is brought into contact with the surface of said open end portion of said second component member defining the opening.

12. The fastening device according to claim 9, wherein the difference between the predetermined lead angle of the threads of said second component member and the second lead angle of the at least one of the threads of said first component member is from about 1° to about 2°.

13. The fastening device according to claim 9, wherein the difference between the predetermined lead angle of the threads of said second component member and the second lead angle of the at least one of the threads of said first component member is at least about 1°.

14. The fastening device according to claim 9, wherein the difference between the predetermined lead angle of the threads of said second component member and the second lead angle of the at least one of the threads of said first component member is less than about 2°.

15. The fastening device according to claim 9, wherein the difference between the predetermined lead angle of the threads of said second component member and the second lead angle of the at least one of the threads of said first component member is about 1.5°.

16. The fastening device according to claim 1, wherein the length of the thread of the second component member extending at the second lead angle is substantially equal to the length of said one of the threads of the second component member extending at the first lead angle.

17. The fastening device according to claim 1, wherein the second component member defines a surface defining its open end portion, and the thread of the second component member extending at the second lead angle and said one of the threads of the second component member extending at the first lead angle are substantially equally spaced from said surface.

18. The fastening device according to claim 1, wherein every other thread of the plurality of threads of the second component member extends at a lead angle which is different than the lead angle associated with its adjacent thread.

* * * * *